United States Patent [19]

Glynn et al.

[11] Patent Number: 4,600,805

[45] Date of Patent: Jul. 15, 1986

[54] FLAT SUBMERSIBLE ELECTRICAL CABLE

[75] Inventors: John R. Glynn, Lawrence, Kans.; Lloyd A. Cobb, Akron, Ohio

[73] Assignee: TRW Inc., Cleveland, Ohio

[21] Appl. No.: 638,150

[22] Filed: Aug. 6, 1984

[51] Int. Cl.[4] ..... H01B 7/18

[52] U.S. Cl. ..... 174/102 R; 174/121 SR

[58] Field of Search ..... 174/102 R, 110 AR, 120 R, 174/120 SR, 120 AR, 121 R, 121 SR, 121 AR, 113 R

[56] References Cited

U.S. PATENT DOCUMENTS

| | | | |
|---|---|---|---|
| 3,299,202 | 1/1967 | Brown | 174/121 R |
| 3,742,363 | 6/1973 | Carle | 174/121 AR X |
| 3,809,802 | 5/1974 | Pearson | 174/103 |
| 3,889,049 | 6/1975 | Legg et al. | 174/120 AR X |
| 4,088,830 | 5/1978 | Wargin et al. | 174/113 R |
| 4,096,351 | 6/1978 | Wargin et al. | 174/102 R |
| 4,284,841 | 8/1981 | Tijunelis et al. | 174/103 |

*Primary Examiner*—Arthur T. Grimley
*Assistant Examiner*—Morris H. Nimmo
*Attorney, Agent, or Firm*—D. G. Blackhurst

[57] ABSTRACT

A low profile electrical cable (10), suitable for use in an oil well where a high temperature corrosive atmosphere is present, and being comprised of a plurality of conductors (12) wherein each conductor is insulated by wrapping it in at least one heat-sealed layer (14) of an insulating material, such as a polyimide plastic. The insulation layer around each conductor is then jacketed by an extruded layer (16) of a material which is mechanically and chemically stable to at least about 400° F. A layer of polyvinyl fluoride tape (18) is disposed around the jacket (16); a braid (20) is wound around the jacket (16) and tape (18) of each conductor to enhance the overall strength characteristics of the cable, and this subassembly is, in turn, further jacketed with a layer (22) of a highly permeable nitrile polymer which provides mechanical and chemical protection for the braid, while preventing gas build-up under the jacket. The insulated and jacketed conductors are then disposed in a side-by-side parallel relationship and wrapped in a metal armor (24), such as galvanized steel. The physical properties of the insulating and jacketing materials allow relatively thin layers to be used for producing a cable which is smaller in overall dimensions than prior cables of comparable electrical capacity.

12 Claims, 1 Drawing Figure

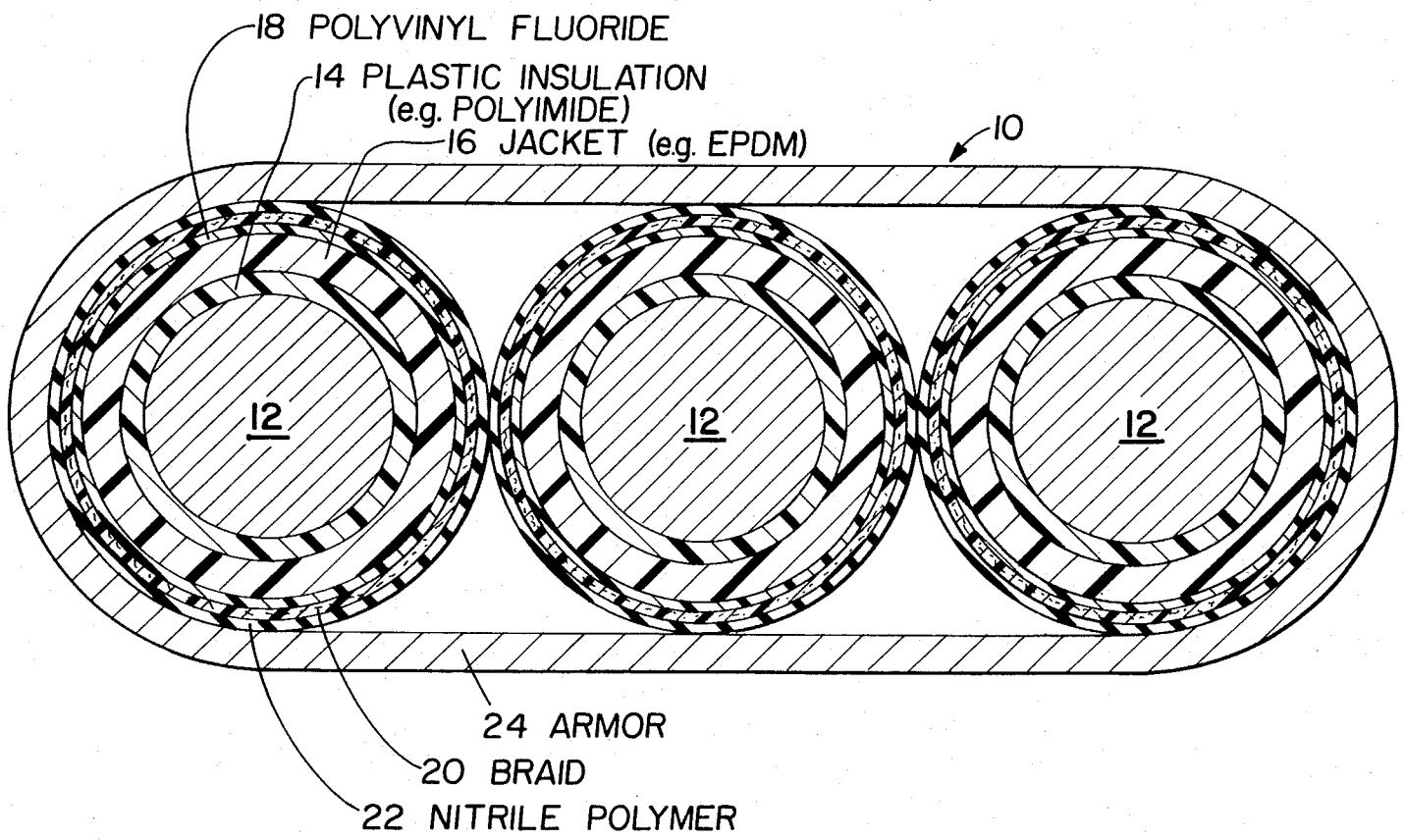
10
12
12
12
18 POLYVINYL FLUORIDE
14 PLASTIC INSULATION
(e.g. POLYIMIDE)
16 JACKET (e.g. EPDM)
24 ARMOR
20 BRAID
22 NITRILE POLYMER

FLAT SUBMERSIBLE ELECTRICAL CABLE

BACKGROUND OF THE INVENTION

The present invention relates to the art of electrical cables and, in particular, to an electrical cable having a flat configuration particularly suitable for use in smaller diameter oil wells where the atmosphere is at elevated temperatures and pressures, and is corrosive. It will be appreciated, however, that the invention has broader applications and may be adapted to other cable applications and uses.

Prior art oil well cables have been designed for use in corrosive, high temperature, and high pressure conditions. Such cables are typically formed with a plurality of conductors, each of which is surrounded by a polymeric insulating material, such as an ethylene-propylene-diene monomer terpolyer (EPDM), with an optional layer of a polyimide plastic often disposed between the conductor and the EPDM. EPDM comprises an elastomer rubber which is permeable by gases in the well. Pressure changes experienced by the cable, as it is thereafter removed from a well, can cause the EPDM material to enlarge or swell. Thus, a braid overwrap has also been provided in some prior art teachings to prevent rupture of the EPDM as a result of swelling. An alternative to wrapping a braid around EPDM insulation to restrain swelling is to encase the insulated conductor in lead. This prevents well gases from reaching the EPDM. Either the lead encased or braid-wrapped conductors may also include an outer wrap of metal or plastic armor. Examples of cables embodying these concepts are shown in U.S. Pat. Nos. 3,809,802; 4,088,830; 4,096,351; and 4,284,841.

Cables used in an oil well type environment are subject not only to chemical attack, but also to mechanical abuse from being installed into and removed from the well itself. Although the lead sheathed cables are not as vulnerable to chemical attack as braid-wrapped cables, the weight of the lead renders mechanical failure far more likely. Moreover, handling of lead sheathed cables is difficult.

While cables having EPDM with a braid overwrap are generally lighter in weight than the lead sheathed cables, they also are subject to mechanical damage, and particularly to so-called embolisms caused by the expansion of entrapped gases on depressurization. One proposed solution was the use of a restraining braid to prevent failure in conjunction with the elimination of any jacket that would add an interface to entrap gases. The problem with this solution is that the insulating material has little or no protection from well fluids and the restraining braid has no protection from abrasion or other mechanical or chemical damage prior to or during the armoring process or while in an oil well.

It has, therefore, been considered desirable to develop a new submersible electrical cable construction. The subject invention is directed to such development which overcomes the foregoing problems and others, and which is deemed to better meet the needs of the industry.

SUMMARY OF THE INVENTION

The present invention provides an electrical cable particularly adapted for use in applications involving high temperatures (up to about 400° F., depending on the type of braid utilized) and corrosive atmospheres (e.g., brine and low levels of hydrogen sulfide, methane and carbon dioxide gases) employing a specially developed highly permeable layer of a nitrile polymer as an outer jacket over the braid. The nitrile polymer layer excludes well fluids and protects the restraining braid, yet is sufficiently permeable to permit absorbed gases to pass out of the cable construction rapidly enough to avoid embolism problems during depressurization.

In general, the cable is comprised of a plurality of conductors preferably insulated with at least one layer of plastic insulating material having a high dielectric strength, and then jacketed with a layer of protective material. The insulated and jacketed conductors are thereafter wrapped in a layer of PVF tape and then a braid structure, after which the subassembly is further jacketed with a layer of a highly permeable nitrile polymer, and optionally finally wrapped in a protective metal armor.

According to the preferred construction, the insulating material comprises a polyimide plastic and the inner protective jacket material comprises an EPDM elastomer.

Also according to the preferred construction, the insulating material is applied in tape form to include a double wrap, and after application, the tape is heat sealed. The EPDM elastomer is then extruded onto the taped covered conductors.

The principal focus of the invention is the provision of a new, improved construction for a submersible electrical cable.

One advantage of the invention resides in the provision of such a cable which has low profile characteristics and which is resistant to the formation or rupture of embolisms.

Another adavantage is the provision of a submersible electrical cable which is relatively unaffected by high temperatures, is resistant to chemically corrosive environments, and has strong mechanical characteristics.

Still other advantages will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawing which forms a part hereof and wherein the FIGURE illustrates a crosssectional view of an electrical cable constructed in accordance with the present invention.

DESCRIPTION OF PREFERRED EMBODIMENT

Referring now to the drawing wherein the showings are for purposes of illustrating the preferred embodiment of the invention only and not for purposes of limiting same, the electrical cable generally designated 10 is adapted to carry electric current to motors and/or other electrically operated apparatus located deep in an oil well. In such an environment, the ambient conditions include corrosive chemicals at high temperatures and pressures. Specifically, cable 10, as described herein, is adapted for use at temperatures ranging up to approximately 315° F. in an environment having brine and low levels of hydrogen sulfide and other gases along with other corrosive compounds.

In the preferred embodiment illustrated, cable 10 includes three parallel, identical conductors 12. In one typical construction, each of conductors 12 comprises a No. 6 solid copper wire; however, it will be appreciated that a greater or lesser number of conductors, or conductors constructed of different materials and/or sizes may be suitably employed. Such modifications are not deemed to in any way depart from the overall intent or scope of the invention.

Each conductor 12 is first closely surrounded with an insulation 14 having a high dielectric strength and which does not break down at elevated temperatures.

In the preferred construction, a polyimide plastic, such as the one manufactured by E. I. Du Pont de Nemours & Company under the trademark KAPTON, is advantageously employed. The polymide plastic is preferably applied as a heat-sealed double wrap of tape with the individual wraps being approximately 50 to 55% overlapped, and wherein such overlap may be either parallel or reversed. This material has a dielectric strength in excess of 5000 volts/mil., and does not break down even at 500° F. After wrapping, the tape is heat sealed by convenient, known means. The preferred material used is marketed under the designation KAPTON; however, it may be possible to insulate conductors 12 with other plastic materials having substantially similar physical characteristics.

A first coating or inner jacket 16 is then placed in a close surrounding relationship with insulation 14 of each conductor 12. For practicing the subject invention, jacket material 16 must comprise a high temperature, chemically and mechanically stable material. In the embodiment under consideration, jacket 16 comprises an EPDM polymeric material. Materials which have been found particularly suitable are disclosed and claimed in U.S. application Ser. No. 638,152 filed 8-6-84.

Coating or first jacket 16 is applied to, preferably extruded onto, each of conductors 12. Jackets 16 constructed with the preferred material are mechanically and chemically stable at elevated temperatures, for example up to a temperature of at least 400° F., and serve to protect insulation layers 14 from chemical corrosion as well as physical abrasion. In the preferred construction, the thickness of each jacket 16 is approximate 75 mils with a wall thickness generally in the range of approximately 55 to 90 mils.

A layer of polyvinyl fluoride (PVF) tape 18 is then disposed around the jacket 16; a suitable material is "TEDLAR" manufactured by E. I. du Pont de Nemours & Company. Over this film a braid surrounds the conductor. While there are a number of well-known materials which may be employed as the braid, such as nylon fiber, polyethylene terephthalatic fiber, glass fiber, a polyamide fiber or a fluropolymer fiber, the preferred braid for the cable of the present invention is a polyvinylidene flouride monofilament, such as KYNAR available from Pennwalt Corp.

A braid 20 is placed around each of jackets 16. The braids are applied in a closely surrounding relationship with the jackets in a convenient manner. Braids 20 preferably comprise a close weave configuration of a polyfluorinated filament yarn or other braid materials with mechanical stability at elevated temperatures, for example at temperatures up to to 300° F. or higher, and provide added protection for each insulated and jacketed conductor.

Typically, such monofilaments have well defined shrink characteristics, generally characterized as either "shrink" or "low shrink". In general, this "shrinking" of such monofilament takes place at about 200° F. By employing a monofilament having high shrink characteristics, it is possible to keep the insulation under compression after the braid reaches a temperature of 200° F. either in the manufacturing process or downhole. Using such high shrink monofilament braid, the design should have a burst strength of at least 2800 psi. In general, a "high shrink" monofilament is one which would shrink at least 8% when heated to a temperature in excess of 200° F. under conditions in which it is not placed under restrictive tension.

A second, outer jacketing layer 22 is then extruded over the braid. This outer jacketing layer is a highly permeable nitrile polymer which provides mechanical and chemical protection for the braid while permitting any entrapped gases to vent through the jacketing layer thereby preventing any embolisms. The nitrile jacket should have a permeability at least three times that of the polyvinyl fluoride tape or other barrier tape. The jacket is flowed onto, into and around the braid to provide maximum protection.

The table below sets forth both a general polymer formulation, and an example of a preferred nitrile polymer composition for use in fabrication of one of the preferred embodiments of the present invention:

TABLE

| INGREDIENT | PREFERRED COMPOSITION phr |
|---|---|
| Nitrile Butadiene Rubber | 100 |
| Polymerized 1,2-dihydro-2,2,4-trimethylquinoline | 2 |
| Stearic acid | 1 |
| Hisil EP | 50 |
| Diisodecyl phthalate | 30 |
| Ross sunproofing wax | 1 |
| Benzothiazyl disulfide | 4 |
| Zinc oxide | 5 |
| Tetramethylthiuram disulfide | 1.5 |
| Spider sulfur | .5 |

A preferred Nitrile Butadiene Rubber is available from The Goodyear Tire & Rubber Co. under the trade designation Chemigum. Using a Custom Scientific Instruments differential volume permeability cell and ASTM test procedure D1434, the permeability coefficient of the processed nitrile material should be in the range of from about 20 to about 50 cc/100 in.$^2$/24 hrs./atm. Excellent results are obtained when the permeability coefficient ranges from about 28 to about 35 cc/100 in.$^2$/24 hrs./atm.

It should be noted that while the foregoing formulation lists the preferred anti-oxidants processing aids and curing agents, other equivalent materials well-known in the art may obviously be substituted.

As shown in the FIGURE, three conductors 12 are disposed in a parallel side-by-side relationship with each other, and closely surrounded by an overwrap of metal armor 24. In the preferred cable construction, a special wrap of a galvanized steel is advantageously utilized. Such a galvanized steel wrap is readily available from the steel industry. Other suitable armors may be fabricated from a nickel-copper alloy or bronze.

The side-by-side or parallel arrangement employed in the subject invention is especially useful in "tight hole" applications, e.g., oil wells of relatively small diameters, where a larger, round cable might cause interference or other problems.

A series of experimental cables were produced corresponding to the preferred embodiment described above.

These experimental cables were subjected to a 30 day test program at various temperatures and pressures, including temperatures of 225° F., 280° F., and 300° F., as well as pressures of 1500 psi and 2500 psi in blends of 50/50 crude and brine, 8% $CO_2$, 2% $H_2S$, and 90% methane. All samples passed these extended tests. A further experimental cable was fabricated in a size suitable to permit downhole evaluation. After about 28 days of downhole use, the cable was pulled and inspected. The materials in the cable construction were found to be "like new".

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A multi-conductor electrical cable for use in a high temperature and high pressure corrosive environment, said cable comprising:

a plurality of electrical conductors; an inner jacket layer of a polymeric material which is mechanically and chemically stable at elevated temperatures closely jacketing each said conductor; a protective braid closely surrounding each of said inner jacket layers, said braids being constructed of a material having mechanical integrity at elevated tempratures; and an outer jacket of nitrile polymer highly permeable to any entrapped gases, and having a permeability constant in the range of from about 20 cc/100 in.$^2$/24 hrs./atm. to about 50 cc/100 in$^2$/24 hrs./atm.

2. The electrical cable as set forth in claim 1 further including at least one first layer of a plastic insulating material having a high dielectric strength disposed between each conductor and its corresponding inner jacket; and an outer protective metal armor surrounding said plurality of insulated jacketed electrical conductors.

3. The electrical cable as set forth in claim 2 wherein the plastic insulating material of said at least one first layers comprises a polyimide plastic.

4. The electrical cable as set forth in claim 3 wherein said at least one first layer comprises a spiral wrap of said polyimide plastic material disposed along the associated conductor, the individual wraps which comprise said spiral wrap being disposed in an overlapping relationship with each other.

5. The electrical cable as set forth in claim 3 wherein said at least one first layer comprises a double wrap of tape disposed around each of said conductors and heat sealed.

6. The electrical cable as set forth in claim 1 wherein said outer jacket of nitrile polymer has been flowed into and around said braid material and has a permeability constant in the range of from about 28 cc/100 in$^2$/24 hrs./atm. to about 35 cc/1000 in$^2$/24 hrs./atm.

7. The electrical cable as set forth in claim 6 wherein the polymeric material of said inner jacket layer comprises an EPDM polymer.

8. The electrical cable as set forth in claim 3 wherein a layer of polyvinyl fluoride film is disposed between said inner jacket and said braid.

9. The electrical cable as set forth in claim 7 wherein a layer of polyvinyl fluoride film is disposed between said inner jacket and said braid.

10. The electrical cable as set forth in claim 7 wherein each inner jacket layer is extruded onto its associated conductor over said first layer.

11. The electrical cable as set forth in claim 7 wherein each inner layer is approximately 75 mils in thickness.

12. The electrical cable as set forth in claim 1 wherein said plurality of conductors are disposed in a parallel, side-by-side relationship to each other.

* * * * *